United States Patent [19]

Knapp

[11] 4,243,003

[45] Jan. 6, 1981

[54] FUEL INJECTION SYSTEM

[75] Inventor: Heinrich Knapp, Leonberg, Fed. Rep. of Germany

[73] Assignee: Robert Bosch GmbH, Stuttgart, Fed. Rep. of Germany

[21] Appl. No.: 39,915

[22] Filed: May 17, 1979

[30] Foreign Application Priority Data

May 27, 1978 [DE] Fed. Rep. of Germany ..... 2823275

[51] Int. Cl.[3] ..... F02M 39/00

[52] U.S. Cl. ..... 123/442; 123/470; 123/455

[58] Field of Search ..... 123/139 AW

[56] References Cited

U.S. PATENT DOCUMENTS

| | | | |
|---|---|---|---|
| 3,777,727 | 12/1973 | Kirchner | 123/139 AW |
| 3,826,233 | 7/1974 | Mennesson | 123/139 AW |
| 3,972,314 | 8/1976 | Du Pont | 123/139 AW |
| 3,976,608 | 7/1976 | Mennesson | 123/139 AW |
| 4,159,703 | 7/1979 | Mayer | 123/139 AW |

*Primary Examiner*—Ronald B. Cox
*Attorney, Agent, or Firm*—Edwin E. Greigg

[57] ABSTRACT

A fuel injection system is proposed which serves for the improved conditioning of the fuel-air mixture fed to a mixture-compressing, spark-ignited internal combustion engine. The fuel injection system comprises preferably an injection valve at the air intake pipe wherein a conditioning member, pivotable by the amount of air introduced in opposition to a resetting force, is arranged downstream of an arbitrarily operable throttle element, this pivoting action being arranged to cause a pressure drop at the conditioning member. The fuel injection takes place through an injection valve disposed in an air bypass beyond the throttle element and the conditioning member. Due to the pressure drop produced by the conditioning member, it is ensured that, in all positions of the throttle element, a constant air stream is maintained via the air bypass, which serves for conditioning the injected fuel.

7 Claims, 3 Drawing Figures

FUEL INJECTION SYSTEM

BACKGROUND OF THE INVENTION

The invention relates to a fuel injection system of the type set forth in the appended claim 1. A fuel injection system provided with a conditioning member that transversely penetrates the air intake manifold has been known, particularly the type wherein the conditioning member, during its opening movement following the operation of the throttle element, is moved in opposition to a resetting force and, in the full-load position of the throttle element, is adapted to maintain a certain minimum pressure drop, i.e., it serves for a better conditioning of the fuel-air mixture in the full-load range. However, this fuel injection system does not permit the conditioning of the injected fuel with air directly after injection, so that there is the danger that fuel will be precipitated onto the manifold walls.

OBJECT AND SUMMARY OF THE INVENTION

The fuel injection system according to the invention, particularly the characterization clause of the main claim, discloses, in contrast to the above, the advantage of a satisfactory mixture preparation with air directly after injection of the fuel in all load ranges of the internal combustion engine, so that very low injection pressures can be employed.

By means of the measures set forth in the dependent claims, further advantageous developments and improvements of the fuel injection system indicated in the main claim are made possible.

The invention will be better understood as well as further objects and advantages thereof become more apparent from the ensuing detailed description of preferred embodiments taken in conjunction with the drawings.

DESCRIPTION OF THE PREFERRED EMBODIMENTS

Figure 1:
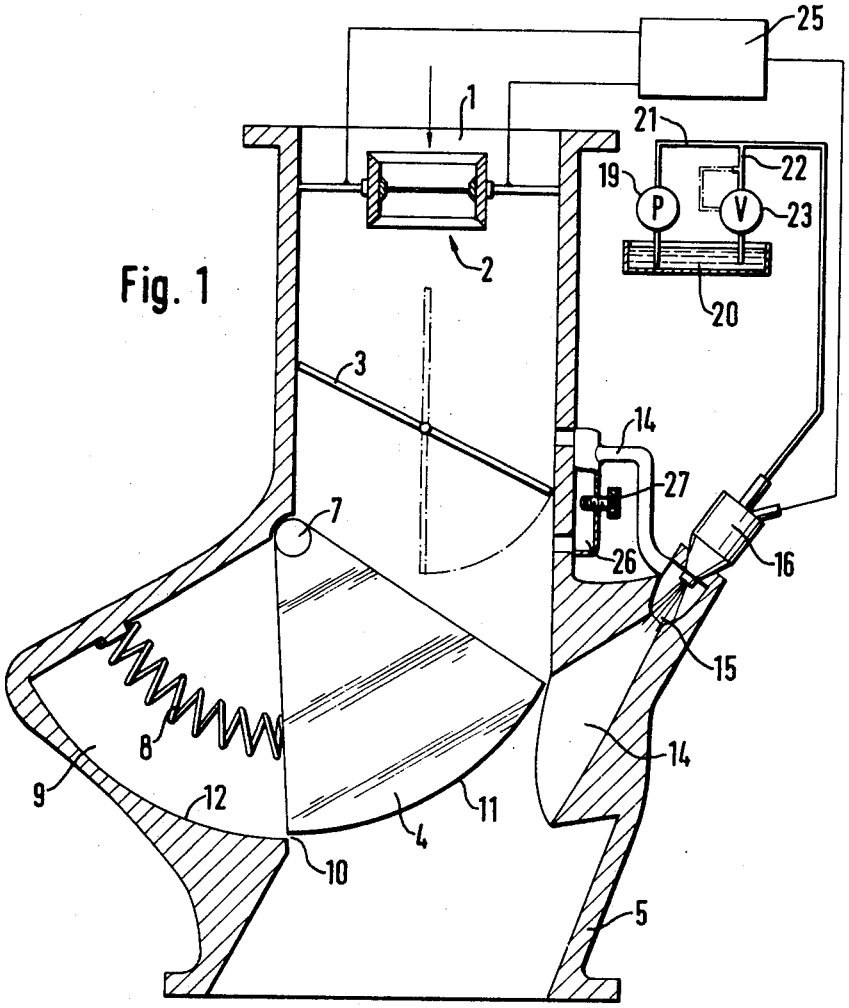
FIG. 1 shows generally in cross section a fuel injection system with throttle element and conditioning member.

Turning now to the drawings of the fuel injection system shown in FIG. 1 for mixture-compressing, spark-ignited internal combustion engines, the introduced combustion air flows downstream of an air filter, not shown, in the direction of the arrow into a throat 1 of the air intake manifold provided with an air measuring instrument constructed, for example, as a hot-wire air volumeter 2, a manually operable throttle element 3, such as a butterfly valve, and an oscillatable conditioning member 4 located downstream of the butterfly valve within the confines of the air intake manifold, via a section 5 of the air intake manifold to the individual cylinders, not shown, of the internal combustion engine. The conditioning member 4 is, for example, in the form of a cylindrical segment and is supported on the wall of the air intake manifold so that it is pivotable about the geometrical center of the cylinder on a bearing axle 7 and so that the conditioning member can control a throughflow cross section for the intake air. The conditioning member 4 can be pivoted into a damping chamber 9 by means of the amount of air introduced, against a spring 8 which serves as the resetting force. The damping chamber 9 is in communication with the intake manifold section 5 downstream of the conditioning member 4 via a throttle point, which latter is formed preferably by the gap 10 disposed between the circular peripheral surface 11 of the conditioning member 4 and the opposed complementally formed wall 12 of the damping chamber. This has the effect that the adjusting movement of the conditioning member 4 takes place in a damped manner even in case of strong intake manifold pulsation at lower speeds. The pressure drop produced at the conditioning member 4 is determined by the force of the spring 8.

An air bypass 14 branches off from the air intake manifold section 1 in a region upstream of the butterfly valve 3; this bypass being arranged to terminate downstream of the conditioning member 4 into the air intake manifold section 5 into the region of the air flow cross section controlled by the conditioning member 4. The air bypass 14 has a venturi-like section 15 into which fuel is injected through an electromagnetic injectino valve 16. By the arrangement of the conditioning member 4 being disposed downstream of the butterfly valve 3, a certain pressure drop is produced with certainty at the conditioning member over all operating ranges of the internal combustion engine, i.e., even in case of higher load and at full load, i.e., a constant flow of air is also maintained in the air bypass 14 to condition the injected fuel. In the venturi-like section 15 of the air bypass 14, an especially intensive intermixing or co-mingling takes place of the injected amount of fuel with the air stream introduced via the air bypass 14. By this preliminary conditioning of the injected fuel with air in the air bypass 14, it is possible to reduce the injection pressure at the injection valve 16 to about 0.3 bar so that economical flow pumps can be used for the fuel supply in the fuel injection system. Without the preliminary conditioning of the injected fuel with air according to this invention, electromagnetic injection valves presently require, for a satisfactory atomization of the fuel, an injection pressure of about 2 bar, so that positive-conveying pumps, e.g. roller cell pumps, are required for the fuel feed.

The fuel supply for the fuel injection valve 16 is effected by a fuel pump 19 which conveys fuel from a fuel tank 20 and then transporting the fuel via a conduit 21 to the injection valve. A conduit 22 branches off from conduit 21; a pressure regulating valve 23 is arranged in conduit 22, through which fuel can flow back into the fuel tank 20. The electromagnetically operable injection valve 16 is controlled in a conventional manner via an electronic control device 25 in dependence on the operating parameters of the internal combustion engine, for example, by the amount of air introduced, which is determined particularly by a hot-wire air volumeter 2. To correct the injected amount of fuel, additional measuring signals which characterize the operating conditions of the internal combustion engine can be fed to the electronic control unit 25, for example by a so-called oxygen probe disposed in the exhaust manifold of the internal combustion engine. To effect idling adjustment, an idling bypass 26, which is arranged to circumvent the butterfly valve 3, is provided, the cross section of this bypass being variable by means of a thumb screw 27.

Figure 2:
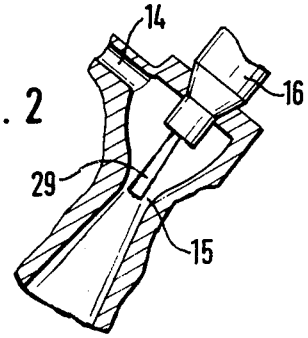
FIG. 2 shows a modified embodiment of the injection valve.

In order to convey the injected fuel to the location of highest air velocity without it coming into contact with the manifold wall, the injection valve 16 can be provided with a lengthened injection needle 29 which extends into the proximity of the narrowest cross section of the venturi-like section 15 of the air bypass 14, from which needle the fuel flow is disrupted by the passing air stream (FIG. 2).

Figure 3:
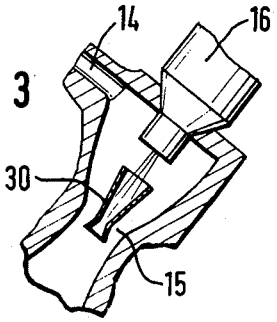
FIG. 3 shows a further modified embodiment of an air bypass of the fuel injection system.

A further improvement of the conditioning of the fuel-air mixture can be attained by constructing the venturi-like section 15 in accordance with FIG. 3 as a dual venturi by arranging a further, secondary venturi-like element 30 in the venturi-shaped section 15 of the air bypass 14.

The foregoing relates to preferred exemplary embodiments of the invention, it being understood that other embodiments and variants thereof are possible within the spirit and scope of the invention, the latter being defined by the appended claims.

What is claimed and desired to be secured by letters patent of the United States is:

1. In a fuel injection system for mixture compressing, spark-ignited internal combustion engines, including: an air intake manifold defining an air flow passage; an arbitrarily operable throttle element mounted within the air intake manifold; a conditioning member mounted within the air intake manifold in series with the arbitrarily operable throttle element; and resetting force applying means engageable with the conditioning member, said conditioning member being mounted within the air intake manifold so that it can be pivoted by the air drawn into the intake manifold against the resetting force applied to the conditioning member by the resetting force applying means, the improvement comprising:

air bypass means connected to the air flow passage of the intake manifold, said air bypass means extending from a region of the air flow passage upstream of the arbitrarily operable throttle element to a region of the air flow passage controlled by the conditioning member;

means within said air bypass means for producing, in operative cooperation with the conditioning member, a constant air flow in the air bypass means; and a fuel injection valve mounted to inject fuel into the air bypass means, wherein a pressure drop is produced at the conditioning member when the engine is in operation so that the constant air flow in the air bypass means is maintained for all positions of the arbitrarily operable throttle element.

2. A fuel injection system according to claim 1, wherein the means for producing a constant air flow in the air bypass means comprises a venturi-like section.

3. A fuel injection system according to claim 2, further wherein said fuel injection valve has a valve needle which terminates in proximity to the narrowest cross section of said venturi-like section.

4. A fuel injection system according to claim 2, further wherein said venturi-like section is arranged to support a secondary venturi into which fuel is injected by said injection valve.

5. A fuel injection system according to claim 1, further wherein said conditioning member comprises a cylindrical segment, is supported on said intake manifold wall and arranged to be pivotable about its geometrical center.

6. A fuel injection system according to claim 5, further wherein said resetting force applying means comprises a spring, and wherein said conditioning member is arranged to oscillate, against the restoring force of said spring, into a damping chamber said conditioning member including a portion that cooperates with said damping chamber to provide a throttle point downstream of said conditioning member.

7. A fuel injection system according to claim 6, further wherein said damping chamber and said conditioning member have complementally formed opposed surfaces and said throttle point is formed therebetween.

* * * * *